US009303227B2

(12) United States Patent
Glover et al.

(10) Patent No.: US 9,303,227 B2
(45) Date of Patent: Apr. 5, 2016

(54) PROCESS AND APPARATUS FOR RECOVERING LPG FROM PSA TAIL GAS

(71) Applicants: Bryan K Glover, Algonquin, IL (US); Marina Minin, Champaign, IL (US)

(72) Inventors: Bryan K Glover, Algonquin, IL (US); Marina Minin, Champaign, IL (US)

(73) Assignee: UOP LLC, Des Plaines, IL (US)

( * ) Notice: Subject to any disclaimer, the term of this patent is extended or adjusted under 35 U.S.C. 154(b) by 399 days.

(21) Appl. No.: 13/904,509

(22) Filed: May 29, 2013

(65) Prior Publication Data

US 2014/0353215 A1 Dec. 4, 2014

(51) Int. Cl.

| | |
|---|---|
| ***C10G 5/02*** | (2006.01) |
| ***C10G 49/22*** | (2006.01) |
| ***C10L 3/12*** | (2006.01) |
| ***C10G 5/04*** | (2006.01) |

(52) U.S. Cl.

CPC .... *C10L 3/12* (2013.01); *C10G 5/04* (2013.01)

(58) Field of Classification Search

None

See application file for complete search history.

(56) References Cited

U.S. PATENT DOCUMENTS

| | | | |
|---|---|---|---|
| 3,430,418 | A | 3/1969 | Wagner |
| 3,431,195 | A | 3/1969 | Storch et al. |
| 3,564,816 | A | 2/1971 | Batta |
| 3,986,849 | A | 10/1976 | Fuderer et al. |
| 4,364,820 | A | 12/1982 | DeGraff et al. |
| 4,374,726 | A | 2/1983 | Schmelzer et al. |
| 4,568,451 | A | 2/1986 | Greenwood et al. |
| 5,012,037 | A | 4/1991 | Doshi et al. |
| 5,178,751 | A | 1/1993 | Pappas |
| 5,332,492 | A | 7/1994 | Maurer et al. |
| 6,592,749 | B1 | 7/2003 | Lokhandwala et al. |

*Primary Examiner* — Randy Boyer

(57) ABSTRACT

A process for recovering liquefied petroleum gas from tail gas includes recovering a tail gas stream from a pressure swing adsorption zone and contacting the tail gas stream with a sponge liquid such as an unstabilized reformate liquid stream in order to recover $C_3^+$ hydrocarbons from the tail gas stream. The $C_3^+$ hydrocarbons may be recovered from the sponge liquid as liquefied petroleum gas.

10 Claims, 1 Drawing Sheet

PROCESS AND APPARATUS FOR RECOVERING LPG FROM PSA TAIL GAS

BACKGROUND OF THE INVENTION

1. Field of the Invention

The present invention generally relates to methods for using a pressure swing adsorption (PSA) zone in combination with a catalytic hydrocarbon conversion zone to improve the purity of a hydrogen-rich gas stream, to improve the recovery of liquefiable hydrocarbons from the hydrocarbon effluent of the catalytic hydrocarbon conversion zone, and to improve the recovery of liquefiable hydrocarbons from PSA tail gas.

2. Description of the Related Art

Various types of catalytic hydrocarbon conversion reaction systems have found widespread utilization throughout the petroleum and petrochemical industries for effecting the conversion of hydrocarbons to different products. The reactions employed in such systems are either exothermic or endothermic. Of more importance to the present invention, the reactions often result in either the net production of hydrogen or the net consumption of hydrogen. Such reaction systems, as applied to petroleum refining, have been employed to effect numerous hydrocarbon conversion reactions including those which predominate in catalytic reforming, ethylbenzene dehydrogenation to styrene, propane and butane dehydrogenation, etc.

Petroleum refineries and petrochemical complexes customarily comprise numerous reaction systems. Some systems within the refinery or petrochemical complex may result in the net production of hydrogen. Because hydrogen is relatively expensive, it has become the practice within the art of hydrocarbon conversion to supply hydrogen from reaction systems which result in the net production of hydrogen to reaction systems which are net consumers of hydrogen. Occasionally, the net hydrogen being passed to the net hydrogen-consuming reactions systems must be of high purity due to the reaction conditions and/or the catalyst employed in the systems. Such a situation may require treatment of the hydrogen from the net hydrogen-producing reaction systems to remove hydrogen sulfide, light hydrocarbons, etc. from the net hydrogen stream.

Alternatively, the hydrogen balance for the petroleum refinery or petrochemical complex may result in excess hydrogen, i.e., the net hydrogen-producing reaction systems produce more hydrogen than is necessary for the net hydrogen-consuming reaction systems. In such an event, the excess hydrogen may be sent to the petroleum refinery or petrochemical complex fuel system. However, because the excess hydrogen often has admixed therewith valuable components, such as $C_3^+$ hydrocarbons, it is frequently desirable to treat the excess hydrogen to recover these components prior to its passage to fuel.

Typical of the net hydrogen-producing hydrocarbon reaction systems are catalytic reforming, catalytic dehydrogenation of alkylaromatics and catalytic dehydrogenation of paraffins. Commonly employed net hydrogen-consuming reaction systems are hydrotreating, hydrocracking and catalytic hydrogenation. Of the above-mentioned net hydrogen-producing and consuming hydrocarbon reaction systems, catalytic reforming ranks as one of the most widely employed. By virtue of its wide application and its utilization as a primary source of hydrogen for the net hydrogen-consuming reactions systems, catalytic reforming has become well known in the art of hydrocarbon conversion reaction systems.

It is well known that high quality petroleum products in the gasoline boiling range including, for example, aromatic hydrocarbons such as benzene, toluene and the xylenes, are produced by the catalytic reforming process, such as a continuous catalyst regeneration (CCR) platforming process, wherein a naphtha fraction is passed to a reaction zone wherein it is contacted with a platinum-containing catalyst in the presence of hydrogen. Generally, the catalytic reforming reaction zone effluent, comprising gasoline boiling range hydrocarbons and hydrogen, is passed to a vapor-liquid equilibrium separation zone and is therein separated into a hydrogen-containing vapor phase and an unstabilized hydrocarbon liquid phase. A portion of the hydrogen-containing vapor phase may be recycled to the reaction zone. The remaining hydrogen-containing vapor phase is available for use either by the net hydrogen-consuming processes or as fuel for the petroleum refinery or petrochemical complex fuel system. While a considerable portion of the hydrogen-containing vapor phase is required for recycle purposes, a substantial net excess is available for the other uses.

Because the dehydrogenation of naphthenic hydrocarbons is one of the predominant reactions of the reforming process, substantial amounts of hydrogen are generated within the catalytic reforming reaction zone. Accordingly, a net excess of hydrogen is available for use as fuel or for use in a net hydrogen-consuming process such as the hydrotreating of sulfur-containing petroleum feedstocks. However, catalytic reforming also involves a hydrocracking function among the products of which are relatively low molecular weight hydrocarbons including methane, ethane, propane, butanes and the pentanes, substantial amounts of which appear in the hydrogen-containing vapor phase separated from the reforming reaction zone effluent. These normally gaseous hydrocarbons have the effect of lowering the hydrogen purity of the hydrogen-containing vapor phase to the extent that purification is often required before the hydrogen is suitable for other uses. Moreover, if the net excess hydrogen is intended for use as fuel in the refinery or petrochemical complex fuel system, it is frequently desirable to maximize the recovery of $C_3^+$hydrocarbons which are valuable as feedstock for other processes.

The pressure swing adsorption (PSA) process provides an efficient and economical means for separating a multi-component gas feedstream containing at least two gases having different adsorption characteristics. The more strongly adsorbable gas can be an impurity which is removed from the less strongly adsorbable gas which is taken off as product; or, the more strongly adsorbable gas can be the desired product, which is separated from the less strongly adsorbable gas. For example, it may be desired to remove carbon monoxide and light hydrocarbons from a hydrogen-containing feedstream to produce a purified, i.e., 99+%, hydrogen stream suitable for hydrocracking or other catalytic process where these impurities could adversely affect the catalyst or the reaction. On the other hand, it may be desired to recover more strongly adsorbable gases, such as ethylene, from a feedstream to produce an ethylene-rich product.

In pressure swing adsorption, a multi-component gas is typically fed to at least one of a plurality of adsorbent beds at an elevated pressure effective to adsorb at least one component, i.e., the adsorbate fraction, while at least one other component passes through, i.e., the non-adsorbed fraction. At a defined time, the feedstream to the adsorbent bed is terminated and the adsorbent bed is depressurized by one or more cocurrent depressurization steps wherein pressure is reduced to a defined level which permits the separated, less strongly adsorbed component or components remaining in the adsorption zone to be drawn off without significant concentration of the more strongly adsorbed components. The released gas typically is employed for pressure equalization and for subsequent purge steps. The bed is thereafter countercurrently depressurized and often purged to desorb the more selectively adsorbed component of the feedstream from the adsorbent and to remove such gas from the feed end of the bed prior to the repressurization thereof to the adsorption pressure.

Such PSA processing is disclosed in U.S. Pat. Nos. 3,430,418, 3,564,816, and 3,986,849, wherein cycles based on the use of multi-bed systems are described in detail. As is generally known and described in these patents, the contents of which are incorporated herein by reference as if set out in full, the PSA process is generally carried out in a sequential processing cycle that includes each bed of the PSA system.

Many processes for the purification of hydrogen-rich gas streams from the effluent of hydrocarbon conversion reaction zones are disclosed. U.S. Pat. No. 3,431,195 discloses a process wherein the hydrogen and hydrocarbon effluent of a catalytic reforming zone is first passed to a low pressure vapor-liquid equilibrium separation zone from which zone is derived a first hydrogen-containing vapor phase and a first unstabilized hydrocarbon liquid phase. The hydrogen-containing vapor phase is compressed and recontacted with at least a portion of the liquid phase and the resulting mixture is passed to a second high pressure vapor-liquid equilibrium separation zone. Because the second zone is maintained at a higher pressure, a new vapor liquid equilibrium is established resulting in a hydrogen-rich gas phase and a second unstabilized hydrocarbon liquid phase. A portion of the hydrogen-rich vapor phase is recycled back to the catalytic reforming reaction zone with the balance of the hydrogen-rich vapor phase being recovered as a hydrogen-rich gas stream relatively free of $C_3$-$C_6$ hydrocarbons.

U.S. Pat. No. 5,178,751 discloses a method for recovering high purity hydrogen gas and increasing the recovery of liquid hydrocarbon products from a hydrocarbon conversion zone effluent wherein the reaction zone effluent is first separated in a vapor-liquid equilibrium separation zone into a first hydrogen-containing vapor phase as a first liquid hydrocarbon phase. One portion of the first hydrogen-containing vapor phase is compressed and recycled back to the catalytic reaction zone. The balance of the hydrogen-containing vapor phase is cooled and recontacted with a portion of the first liquid hydrocarbon phase and passed to a second vapor-liquid separation zone to provide a second hydrogen-containing vapor phase and a second hydrocarbon phase. The second hydrogen-containing vapor phase is admixed with a portion of the first liquid hydrocarbon phase, refrigerated and passed to a third vapor-liquid separation zone to provide a high purity hydrogen stream and a third liquid hydrocarbon phase. The liquid hydrocarbon phases are collected and passed to fractionation for recovery of liquid hydrocarbon products.

Other references which disclose processes for improving the recovery of a hydrogen-rich gas stream reaction zone effluent comprising hydrogen and hydrocarbons from a hydrocarbon conversion zone include U.S. Pat. Nos. 4,568,451, 4,374,726, and 4,364,820.

U.S. Pat. No. 5,332,492 discloses a particular arrangement of a pressure swing adsorption zone, separators and refrigeration equipment that dramatically improves the purity of the hydrogen recovered and improves recovery of liquefiable hydrocarbons in such a system with only a relatively simple arrangement of components. However, tail gas derived from the PSA process in such an arrangement will still contain quantities of hydrocarbons with three or more carbon atoms ($C_3^+$) such as propane and isobutane.

Therefore, there is a need in the art for a process and apparatus that can be used to recover $C_3^+$ hydrocarbons from PSA tail gas as these $C_3^+$ hydrocarbons are valuable as liquefied petroleum gas (LPG) products. By recovering residual $C_3^+$ in the PSA tail gas, one could increase the yield of LPG and $C_5^+$ (5 or more carbon atoms) hydrocarbons recovered from a CCR platforming unit and improve the overall economies of the combined process.

SUMMARY OF THE INVENTION

The foregoing needs are met by a process for recovering liquefied includes the steps of: (a) passing at least a portion of an effluent comprising hydrogen and hydrocarbon from a catalytic hydrocarbon conversion reaction zone to a first vapor-liquid separation zone and recovering from the first vapor-liquid separation zone a first hydrogen-rich gas stream and a first liquid stream comprising hydrocarbons; (b) admixing a portion of the first hydrogen-rich gas stream and at least a portion of the first liquid stream to produce a first admixture; (c) passing the first admixture to a second vapor-liquid separation zone to produce a second hydrogen-rich gas stream and a second liquid stream; (d) passing the second hydrogen-rich gas stream to a pressure swing adsorption zone containing an adsorbent selective for the separation of hydrogen from hydrocarbons and separating the second hydrogen-rich gas stream into a third hydrogen-rich stream and a tail gas stream; (e) admixing a portion of the tail gas stream and at least a portion of the second liquid stream to produce a second admixture; and (f) recovering liquefied petroleum gas from the second admixture. The process may further comprise recovering at least a portion of the third hydrogen-rich stream as a high purity hydrogen product. Step (f) may further comprise passing the second admixture to a third vapor-liquid separation zone to produce a lean tail gas stream and a third liquid stream. Step (f) may further comprise passing the third liquid stream to a fourth vapor-liquid separation zone to produce a liquefied petroleum gas stream and a fourth liquid stream. The liquefied petroleum gas stream and the tail gas stream may comprise $C_3^+$ hydrocarbons, such as isobutane and propane. In the process, the tail gas stream optionally is not recycled to the catalytic hydrocarbon conversion reaction zone. The second admixture of step (e) may further comprise admixing a sponge liquid.

The foregoing needs are also met by a process for recovering liquefied petroleum gas from tail gas. The process includes the steps of: (a) passing at least a portion of an effluent comprising hydrogen and hydrocarbon from a catalytic hydrocarbon conversion reaction zone to a first vapor-liquid separation zone and recovering from the first vapor-liquid separation zone a first hydrogen-rich gas stream and a first liquid stream comprising hydrocarbons; (b) admixing a portion of the first hydrogen-rich gas stream and at least a portion of the first liquid stream to produce a first admixture; (c) passing the first admixture to a second vapor-liquid separation zone to produce a second hydrogen-rich gas stream; (d) passing the second hydrogen-rich gas stream to a pressure swing adsorption zone containing an adsorbent selective for the separation of hydrogen from hydrocarbons and separating the second hydrogen-rich gas stream into a third hydrogen-rich stream and a tail gas stream; (e) admixing a portion of the tail gas stream and a second liquid stream to produce a second admixture; and (f) recovering liquefied petroleum gas from the second admixture. The second liquid stream may comprise a sponge liquid.

The foregoing needs are also met by an apparatus for recovering liquefied petroleum gas from tail gas. The apparatus includes a catalytic hydrocarbon conversion reaction zone; a first vapor-liquid separation zone wherein the first vapor-liquid separation zone is in downstream communication with the catalytic hydrocarbon conversion reaction zone, and in upstream communication with a first vapor product conduit and a first liquid product conduit; a second vapor-liquid separation zone wherein the second vapor-liquid separation zone is in downstream communication with the first vapor product conduit, the first liquid product conduit and a first tail gas conduit, and in upstream communication with a second vapor product conduit and a second liquid product conduit; a pressure swing adsorption zone wherein the pressure swing adsorption zone is in downstream communication with the second vapor product conduit, and in upstream communication with a purified hydrogen product conduit and a first tail gas conduit; and a liquefied petroleum gas recovery zone wherein the liquefied petroleum gas recovery zone is in downstream communication with the first tail gas conduit and the second liquid product conduit.

The liquefied petroleum gas recovery zone of the apparatus may include a third vapor-liquid separation zone wherein the third vapor-liquid separation zone is in downstream communication with the first tail gas conduit and the second liquid product conduit, and the third vapor-liquid separation zone is in upstream communication with a lean tail gas conduit and a rich liquid conduit.

The liquefied petroleum gas recovery zone of the apparatus may include a fourth vapor-liquid separation zone wherein the fourth vapor-liquid separation zone is in downstream communication with the rich liquid conduit, and in upstream communication with a light hydrocarbon conduit and a heavy hydrocarbon conduit.

The light hydrocarbon conduit may convey a $C_3^+$ hydrocarbons stream comprising isobutane and propane. The tail gas conduit may convey a tail gas stream comprising gaseous hydrogen and $C_3^+$ hydrocarbons comprising isobutane and propane.

In the apparatus, the pressure swing adsorption zone may contain an adsorbent selective for the separation of hydrogen from hydrocarbons. The catalytic hydrocarbon conversion reaction zone may be in downstream communication with the first vapor product conduit. The liquefied petroleum gas recovery zone may be in downstream communication with a source of a sponge liquid.

These and other features, aspects, and advantages of the present invention will become better understood upon consideration of the following detailed description, drawings and appended claims.

DETAILED DESCRIPTION OF THE INVENTION

Definitions

Figure 1:
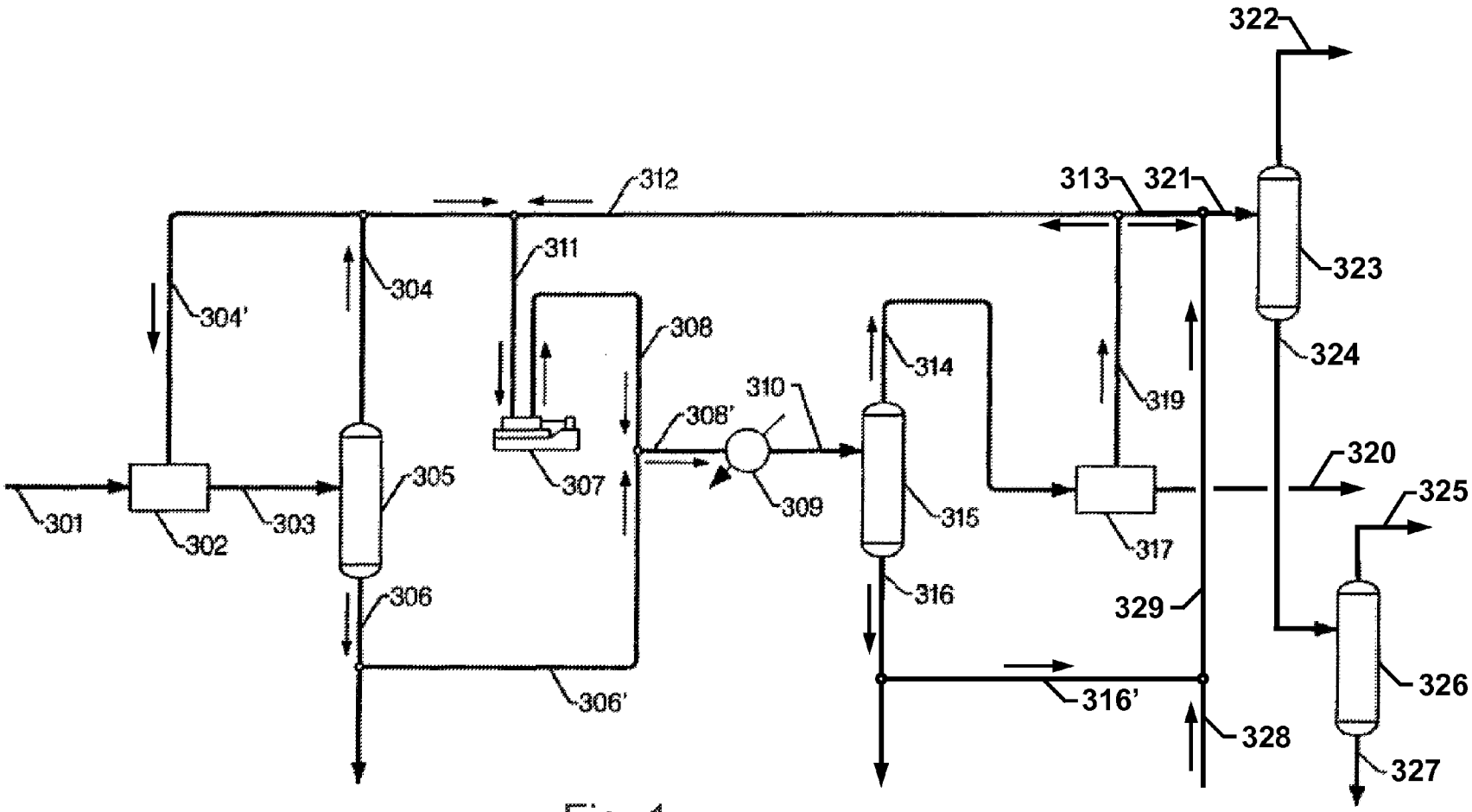
FIG. 1 illustrates a reforming process and separation arrangement for recovering liquefied petroleum gas from PSA tail gas according to the invention.

As used herein, the following terms have the corresponding definitions. The term "communication" means that material flow is operatively permitted between enumerated components. The term "$C_x$" wherein "x" is an integer means a hydrocarbon stream with hydrocarbons have x and/or less carbon atoms, and preferably x and less carbon atoms. The term "$C_x^+$" wherein "x" is an integer means a hydrocarbon stream with hydrocarbons have x and/or more carbon atoms, and preferably x and more carbon atoms. The term "communication" means that material flow is operatively permitted between enumerated components. The term "downstream communication" means that at least a portion of material flowing to the subject in downstream communication may operatively flow from the object with which it communicates. The term "upstream communication" means that at least a portion of the material flowing from the subject in upstream communication may operatively flow to the object with which it communicates.

Description of The Invention

The process and apparatus of this invention is suitable for use in recovering $C_3^+$ hydrocarbons from a gas stream. The process may be integrated with hydrocarbon conversion reaction systems which may be characterized as single or multiple reaction zones in which catalyst particles are disposed as fixed beds or movable via gravity flow. The present invention may be advantageously utilized in hydrocarbon conversion reaction systems which result in the net production or the net consumption of hydrogen, and furthermore, in systems wherein purification of the hydrogen in a PSA zone results in a tail gas stream containing $C_3^+$ hydrocarbons. Although the following discussion is specifically directed toward catalytic reforming of naphtha boiling range fractions, there is no intent to so limit the present invention.

First, a catalytic reforming process is described to provide context for one exemplary system which produces a gas stream containing $C_3^+$ hydrocarbons. Second, methods for recovering $C_3^+$ hydrocarbons are described with a focus on the aspects of the present invention. Finally, a detailed description of the figures is provided to illustrate the process and apparatus of the present invention.

The art of catalytic reforming is known to the petroleum refining and petrochemical processing industry. Accordingly, a detailed description thereof is not required herein. In brief, the catalytic reforming art is largely concerned with the treatment of a petroleum gasoline fraction to improve its anti-knock characteristics. The petroleum fraction may be a full boiling range gasoline fraction having an initial boiling point of from about 10° C. (50° F.) to about 38° C. (100° F.) and an end boiling point from about 163° C. (325° F.) to about 218° C. (425° F.). More frequently, the gasoline fraction will have an initial boiling point to about 65° C. (150° F.) to about 121° C. (250° F.) and an end boiling point of from about 177° C. (350° F.) to about 218° C. (425° F.), this higher boiling fraction being commonly referred to as naphtha. The reforming process is particularly applicable to the treatment of those straight-run gasolines comprising relatively large concentrations of naphthenic and substantially straight-chain paraffinic hydrocarbons which are amenable to aromatization through dehydrogenation and/or cyclization. Various other concomitant reactions also occur, such as isomerization and hydrogen transfer, which are beneficial in upgrading the anti-knock properties of the selected gasoline fraction. In addition to improving the anti-knock characteristics of the gasoline fraction, the tendency of the process to produce aromatics from naphthenic and paraffinic hydrocarbons makes catalytic reforming an invaluable source for the production of benzene, toluene, and xylenes which are all of great utility in the petrochemical industry.

Widely accepted catalysts for use in the reforming process typically comprise platinum on an alumina support. These catalysts will generally contain from about 0.05 wt. % to about 5 wt. % platinum. Certain promoters or modifiers, such as cobalt, nickel, rhenium, germanium and tin, have been incorporated into the reforming catalyst to enhance its performance.

The catalytic reforming of naphtha boiling range hydrocarbons, a vapor phase operation, is effected at conversion conditions which include catalyst bed temperatures in the range of from about 371° C. (700° F.) to about 549° C. (1020° F.) Other conditions generally include a pressure of from about 138 kPa (20 psia) to about 6900 kPa (1000 psia), a liquid hourly space velocity (defined as volumes of fresh charge stock per hour per volume of catalyst particles in the reaction zone) of from about 0.2 to about 10 $hr^{-1}$ and a hydrogen to hydrocarbon mole ratio generally in the range of from about 0.5:1 to about 10:1.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor vessel, or the catalyst beds may each be enclosed in a separate reactor vessel in a side-by-side reactor arrangement. Generally, a reaction zone will comprise two to four catalyst beds in either the stacked and/or side-by-side configuration. The amount of catalyst used in each of the catalyst beds may be varied to compensate for the endothermic heat of reaction in each case. For example, in a three-catalyst bed system, the first bed will generally contain from about 10 to about 30 vol. %; the second, from about 25 to about 45 vol. %; and the third, from about 40 to about 60 vol. %, all percentages being based on the amount of catalyst within the reaction zone. With respect to a four-catalyst bed system, suitable catalyst loadings would be from about 5 to about 15 vol. % in the first bed, from about 15 to about 25 vol. % in the second, from about 25 to about 35 vol. % in the third, and from about 35 to about 50 vol. % in the fourth. The reactant stream, comprising hydrogen and the hydrocarbon feed, should desirably flow serially through the reaction zones in order of increasing catalyst volume and interstage heating. The unequal catalyst distribution, increasing in the serial direction of reactant stream flow, facilitates and enhances the distribution of the reactions.

Continuous regenerative reforming systems offer numerous advantages when compared to the fixed bed systems. Among these is the capability of efficient operation at comparatively lower pressures, e.g., 138 to 1379 kPa (20 to 200 psig), and higher liquid hourly space velocities, e.g., about 3 to about 10 $hr^{-1}$. As a result of continuous catalyst regeneration, higher consistent inlet catalyst bed temperatures can be maintained, e.g., 510° C. (950° F.) to about 543° C. (1010° F.). Furthermore, there is afforded a corresponding increase in hydrogen production and hydrogen purity in the hydrogen-containing vaporous phase from the product separation facility.

Upon removal of the effluent comprising hydrocarbon and hydrogen from the catalytic reaction zone, it is customarily subjected to indirect heat exchange typically with the hydrogen and hydrocarbon feed to the catalytic reaction zone. Such an indirect heat exchange aids in the further processing of the reaction zone effluent by cooling it and recovers heat, which would otherwise be lost, for further use in the catalytic reforming process. Following any such cooling step, which may be employed, the reaction zone effluent is passed to a vapor-liquid equilibrium separation zone to recover a hydrogen-rich gas stream from the effluent, at least a portion of which is to be recycled back to the reforming zone. The vapor-liquid equilibrium separation zone is usually-maintained at substantially the same pressure as employed in the reforming reaction zone, allowing for the pressure drop in the system. The temperature within the vapor-liquid equilibrium separation zone is typically maintained at about 15° C. to about 49° C. (about 60° F. to about 120° F.). The temperature and pressure are selected in order to produce a hydrogen-rich gas stream and a principally liquid stream comprising unstabilized reformate.

As noted previously, the catalytic reforming process generally requires the presence of hydrogen within the reaction zone. Although this hydrogen may come from any suitable source, it has become the common practice to recycle a portion of the hydrogen-rich gas stream derived from the vapor-liquid equilibrium separation zone to provide at least part of the hydrogen required to assure proper functioning of the catalytic reforming process. The balance of the hydrogen-rich gas stream is therefore available for use elsewhere. As noted above, a first liquid stream comprising a principally liquid phase which may include unstabilized reformate is withdrawn from the first vapor-liquid equilibrium separation zone. Pursuant to the invention, a portion of this first liquid stream comprising from about 10 to 50 vol. % of the first liquid stream, and preferably 20 to 40 vol. %, is passed to a heat exchange means for indirect heat exchange with a hereinafter defined second liquid stream.

After subjecting it to indirect heat exchange, at least a portion of the first liquid stream is admixed with the hydrogen-rich gas stream which has also been subjected to indirect heat exchange. Admixing a hydrogen-rich gas stream with a suitable liquid stream is known as recontacting. One of the purposes of recontacting is to recover hydrocarbon materials such as $C_3^+$ hydrocarbons from hydrogen-rich gas stream. During recontacting, $C_3^+$ hydrocarbons may partition under equilibrium conditions into the liquid stream wherein downstream separation processes may be used to recover the $C_3^+$ hydrocarbons from the liquid stream. While one recontacting step is described in the context of the present invention, additional recontacting steps may be incorporated into the catalytic hydrocarbon conversion and separation system. One such system with multiple recontacting steps is described in U.S. Pat. No. 5,332,492, which is herein incorporated by reference in its entirety. Furthermore, a recontacting step may be include a single stage vapor-liquid flash process or a multistage process involving co-current or counter-current recontacting of the gas and liquid streams.

Heat exchange of the first hydrogen-rich gas stream with a second hydrogen-rich gas stream (or other suitable stream) precools the first hydrogen-rich gas stream before it enters a recontacting zone or second separation zone. Similarly heat exchange of the first liquid hydrocarbon stream from the first separator with a combined liquid product stream precools the liquid hydrocarbon stream that enters the second separator. This precooling will usually provide enough of a temperature reduction in the first hydrogen-rich gas stream to produce favorable equilibrium conditions in the second separation zone for reducing the content of liquefiable hydrocarbons in the second hydrogen-rich gas stream from the second vapor-liquid separation zone.

As the resulting first admixture is passed to the second vapor-liquid equilibrium separation zone, or recontacting zone, the composition temperature and pressure of the gas and vapor liquid entering the second vapor-liquid equilibrium separation zone is different from that in the first separation zone so that a new vapor equilibrium is established. Generally, the conditions within the second vapor-liquid separation zone will include a temperature of from about −4° C. to about 24° C. (about 25° F. to 75° F.), preferably, in a range of from about 4° C. to about 15° C. (about 40° F. to 60° F.) and a pressure of from about 345 kPa to about 3550 kPa (50 to 515 psia). A vapor-liquid separation zone usually consists of an open vessel that operates in the nature of a flash drum. The pressure and temperature conditions within the second vapor-liquid separation zone will be set in order recover a recontacted hydrogen stream, or a third hydrogen-rich gas stream of medium purity. For the purposes of this invention, medium purity will usually mean a purity of 85 to 95 mol % hydrogen.

The second hydrogen-rich gas stream from the second separation zone provides substantial cooling to the hydrogen-containing vapor stream that forms a portion of the first admixture. Additional cooling of the liquid reformate stream is provided by the bottoms stream from the second separation zone (e.g., via a feed-effluent heat exchange process). In some cases it may be desirable to provide refrigeration of the first admixture that enters the second separation zone. In such cases the temperature of the admixture will usually be in a range of from about −26° C. to about −9° C. (about −15° F. to 15° F.) before it enters the second separation zone and will have a pressure of from about 345 to about 3550 kPa (about 50 to 515 psia).

As will readily be recognized by the practitioner, upon precooling, a small portion of the first hydrogen-rich gas stream may partially condense; however, it is to be understood that the term "hydrogen-rich gas stream" as used herein is intended to include that small condensed portion. Hence, the entire hydrogen-rich gas stream including any portion thereof condensed upon precooling is admixed with the liquid stream.

In accordance with the present invention, the hydrogen-rich gas stream from the second separation zone and/or the hydrogen-rich gas stream from the first separation zone may be subjected to refrigeration. Although not typically necessary for catalytic reforming, it may be necessary to assure that these hydrogen-rich gas streams are sufficiently dry prior to refrigeration. Drying of the first hydrogen-rich gas stream from the first separation zone may be necessary because water, intentionally injected into the reaction zone or comprising a reaction zone feed contaminant must be substantially removed to avoid formation of ice upon refrigeration. By drying the first hydrogen-rich gas streams, formation of ice and the resulting reduction of heat transfer coefficients in the heat exchanger of the refrigeration unit utilized to effect the cooling are avoided.

If drying is required, it may be effected by any means known in the art. Absorption using liquid desiccants such as ethylene glycol, diethylene glycol, and triethylene glycol may be advantageously employed. In such an absorption system, a glycol desiccant is contacted with the hydrogen-containing vapor phase in an absorber column. Water-rich glycol is then removed from the absorber and passed to a regenerator wherein the water is removed from the glycol desiccant by application of heat. The resulting lean glycol desiccant is then recycled to the absorber column for further use. As an alternative to absorption using liquid desiccants, drying may also be effected by adsorption utilizing a solid desiccant. Alumina, silica gel, silica-alumina beads, and molecular sieves are typical of the solid desiccants which may be employed. Generally, the solid desiccant will be placed in at least two beds in a parallel flow configuration. While the hydrogen-containing vapor phase is passed through one bed of desiccant, the remaining bed or beds are regenerated. Regeneration is generally effected by heating to remove desorbed water and purging the desorbed water vapor from the desiccant bed. The beds of desiccant may, therefore, be cyclically alternated between drying and regeneration to provide continuous removal of water from the hydrogen-containing vapor phase.

In regard to refrigeration, any suitable refrigeration means may be employed. For example, a simple cycle comprising a refrigerant evaporator, compressor, condenser, and expansion valve or if desired, a more complex cascade system may be employed. The exact nature and configuration of the refrigeration scheme is dependent on the desired temperature of the refrigerated admixture and in turn that temperature is dependent on the composition of the admixture and the desired hydrogen purity of the hydrogen-rich gas. Preferably, the temperature should be as low as possible with some margin of safety to prevent freezing. Generally, the refrigeration temperature will be from about −26° C. to about −9° C. (about −15° F. to 15° F.). In addition, it should be noted that the exact desired temperature of the refrigerated admixture will determine whether drying of the hydrogen-containing vapor phase is necessary in order to avoid ice formation within the refrigeration heat exchanger and the concomitant reduction in heat transfer coefficient accompanied therewith. For catalytic reforming, a temperature of about −18° C. (about 0° F.) is usually suitable without the necessity of drying the hydrogen-containing vapor phase. This is because the water content of the hydrogen-containing vapor phase is about 20 mole ppm.

The product withdrawn from the second vapor-liquid separation zone as the second liquid stream will differ from the first liquid stream in that the second liquid stream will contain more $C_1^+$ material transferred from the first hydrogen-rich gas stream. The liquid streams withdrawn from the second and third, vapor-liquid equilibrium separation zones may be passed to a fractionation zone after being subjected to indirect heat exchange in accordance with the invention. By subjecting the second liquid stream to indirect heat exchange, it is thereby preheated prior to its passage to the fractionation zone. The indirect heat exchange step therefore results in supplementary energy savings by avoiding the necessity of heating the liquid streams from the temperature at which the second vapor-liquid equilibrium separation zone is maintained prior to fractionation and also by reducing the refrigeration requirement of the system. Alternatively, at least a portion of the liquid stream withdrawn from the second vapor-liquid equilibrium separation zone may be contacted with a portion of the PSA tail gas stream as discussed hereinafter.

The hydrogen-rich gas stream withdrawn from the second vapor-liquid equilibrium separation zone will preferably have, depending on the conditions therein, a hydrogen purity in excess of 90 mol. %. After subjecting the hydrogen-rich gas stream to indirect heat exchange pursuant to the invention, the hydrogen-rich gas stream is typically be passed to other hydrogen-consuming processes. It should be noted that by subjecting the hydrogen-rich gas stream to indirect heat exchange with the hydrogen-containing vapor phase, there accrues certain supplementary energy savings. Accordingly, by subjecting the hydrogen-rich gas to indirect heat exchange and thereby warming it, energy savings will be achieved, avoiding the necessity of heating the hydrogen-rich gas stream from the temperature maintained in the second vapor-liquid equilibrium separation zone. Additionally, such a heat exchange step decreases the total refrigeration requirements further reducing the energy requirements of the system.

In accordance with the present invention, the hydrogen-rich gas stream from the second vapor-liquid separation zone is passed to a pressure swing adsorption (PSA) zone to produce a hydrogen stream with a purity ranging from 90.0 to 99.9999 mol % hydrogen, and preferably from 95.0 to 99.99 vol. % hydrogen. A tail gas stream is produced by the PSA zone during a desorption or purge step at a desorption pressure ranging from about 35 kPa to about 550 kPa (about 5 psia to about 80 psia). It was found that the return of a portion of the tail gas stream to a liquid hydrocarbon recovery scheme at a point prior to a recontacting step, the recovery of liquid hydrocarbons from the reactor effluent could be improved.

Hydrogen purification in the PSA zone can be carried out using any adsorbent material which is selective for the separation of hydrogen from hydrocarbons in the adsorbent beds within the PSA zone. Suitable adsorbents known in the art and commercially available for use in the PSA zone include crystalline molecular sieves, activated carbons, activated clays, silica gels, activated aluminas, and combinations thereof. Preferably the adsorbents used with the present invention will be selected from the group consisting of activated carbon, alumina, activated alumina, silica gel, and combinations thereof.

There is a significant benefit in the integration of the PSA zone with a catalytic reformer when the hydrogen content in the hydrogen-rich gas from the first separation zone was greater than 70 mol-% hydrogen, and preferably when the hydrogen purity of the hydrogen-rich gas from the first separation zone was greater than 77 mol-% hydrogen. Furthermore, a number of economic benefits may result when at least 20 to 90 percent of the tail gas stream from the PSA zone is returned to the recontacting zone.

The production of a hydrogen product stream with a purity greater than 99 vol % hydrogen is particularly valuable when the hydrogen-consuming process unit to which this hydrogen product stream will be sent is a catalytic unit. The increase in the purity of the hydrogen product stream sent to a catalytic hydrocracking reaction zone from a catalytic reforming unit may result in significant utility and capital savings in the combination of the catalytic hydrocracking reaction zone and the catalytic reforming reaction zone. It is believed that the increase in the purity of the hydrogen increases the partial pressure of hydrogen in the catalytic hydrocracking reaction zone which permits the operating of the hydrocracking reaction zone at a lower pressure for the same degree of conversion.

The operation of the PSA zone relates to conventional PSA processing comprising a plurality of adsorption beds containing an adsorbent selective for the separation of hydrogen from the hydrocarbons, wherein each adsorption bed within the adsorption zone undergoes, on a cyclic basis, high pressure adsorption, optional cocurrent depressurization to intermediate pressure level(s) with release of void space from the product end of the adsorption bed, countercurrent depressurization to lower desorption pressure with the release of desorbed gas from the feed end of the adsorption bed, with or without purge of the bed, and repressurization to higher adsorption pressure. The process may also include an addition to this basic cycle sequence, which includes the use of a cocurrent displacement step, or co-purge step in the adsorption zone following the adsorption step in which the less readily adsorbable component, or hydrogen, is essentially completely removed therefrom by displacement with an external displacement gas introduced at the feed and of the adsorption bed. The adsorption zone is then countercurrently depressurized to a desorption pressure that is at or above atmospheric pressure with the more adsorbable component being discharged from the feed end thereof. In multibed adsorption systems, the displacement gas used for each bed is advantageously obtained by using at least a portion of the debutanizer overhead vapor stream, although other suitable displacement gas such as an external stream comprising $C_1$ to $C_4$ hydrocarbons may also be employed if available with respect to the overall processing operation in which PSA with product recovery is being employed.

The high pressure adsorption step of the PSA process comprises introducing the feedstream or hydrogen-rich gas stream to the feed end of the adsorption bed at a high adsorption pressure. The hydrogen passes through the bed and is discharged from the product end thereof. An adsorption front or fronts are established in the bed with said fronts likewise moving through the bed from the feed end toward the product end thereof. Preferably, the adsorption zone pressure ranges from about 345 kPa to about 3550 kPa (about 50 to about 515 psia). It is to be understood that the adsorption zones of the present invention contain adsorber beds containing adsorbent suitable for adsorbing the hydrocarbon components to be adsorbed therein. As the capacity of the adsorber bed for the hydrocarbon components is reached, that is, preferably before a substantial portion of the leading adsorption front has passed through the first adsorber bed, the feedstream is directed to another bed in the adsorption zone. The loaded bed is then desorbed by depressurizing the bed to a desorption pressure in a direction countercurrent to the feeding step. Next, the bed is purged for further desorption and void space cleaning by passing a purge gas therethrough, preferably in a countercurrent direction. It is to be also understood that the term "countercurrent" denotes that the direction of gas flow through the adsorption zone, i.e., adsorption bed, is countercurrent with respect to the direction of feed stream flow. Similarly, the term "concurrent" denotes flow in the same direction as the feedstream flow. The purge gas is at least partially comprised of an effluent stream, e.g., the adsorption effluent stream or the cocurrent displacement effluent stream, from the adsorption zone and is rich in hydrogen, i.e., the greater than 50 mol. % hydrogen. Of course it is to be understood that the adsorption cycle in the adsorption zone can comprise additional steps well known in PSA such as cocurrent depressurization steps or cocurrent displacement steps. Accordingly, the adsorption zone can comprise more than two adsorption beds. The desorption and purge effluent streams from the adsorption zone can be recovered from the process as a tail gas stream.

A displacement gas is passed through the bed in a direction cocurrent to the feeding step. By the use of a cocurrent displacement gas essentially free of hydrogen, thus having a molar concentration of hydrocarbon components relative to the feedstream, the hydrocarbon components that remains in the void spaces of the adsorbent bed ahead of the leading adsorption front can be essentially completely displaced from the bed. Depending upon the available pressure of the displacement gas, the cocurrent displacement step can be performed in conjunction with one or more cocurrent depressurization step. When a cocurrent depressurization step is used, it can be performed either before, simultaneously with, or subsequent to the displacement step. The final pressure achieved during cocurrent depressurization steps is intermediate between the adsorption and desorption pressures and is preferably within the range of from about 300 kPa to about 1830 kPa (about 45 psia to about 265 psia). The effluent stream from the cocurrent depressurization step, which is comprised primarily of hydrogen, can be used to partially repressurize another adsorption bed. It can also be utilized, at least in part, to purge the adsorption zone as hereinbefore described.

After the termination of the cocurrent displacement step and any desired cocurrent depressurization step(s), the adsorption bed is desorbed by reducing the pressure in a direction countercurrent to the feeding direction to a desorption pressure. Other hydrogen-containing streams such as vent gases from catalytic hydrocarbon reaction zones originating from such processes as catalytic hydrotreating reaction zones or catalytic hydrocracking reaction zones can benefit from the hydrogen enrichment provided. Accordingly, a portion of a hydrogen-rich gas stream from another hydrocarbon reaction zone can be admixed with the second hydrogen-rich gas stream to recover additional hydrogen for the other hydrocarbon reaction zone. A portion of the high purity hydrogen product is returned to the other hydrocarbon reaction zone.

The tail gas stream from the PSA zone may contain hydrogen, methane, ethane and some quantities of $C_3^+$ hydrocarbons. Generally, the value of the $C_3^+$ material is significantly higher than the value of the $C_1$ and $C_2$ hydrocarbon species. One means of recovering $C_3^+$ hydrocarbons from PSA tail gas in a PSA unit integrated with a catalytic hydrocarbon conversion system is to add a liquid absorber to the PSA tail gas stream to recover $C_3^+$ hydrocarbons. According to the process and apparatus of the present invention, the tail gas stream provided by the PSA zone can be contacted with a sponge liquid such as a portion of the liquid stream withdrawn from the second vapor-liquid equilibrium separation zone. $C_3^+$ hydrocarbons are concentrated in the tail gas relative to the hydrogen-rich gas stream from the second vapor-liquid separation zone. Therefore, the liquid stream withdrawn from the second and vapor-liquid equilibrium separation zone can be contacted with the tail gas stream to recover additional $C_3^+$ hydrocarbons.

Alternative sources of sponge liquid may include feed or product liquid from an isomerization unit (ideally a non-chlorine containing stream) or debutanized reformate product associated with the catalytic reforming unit. After contacting with the tail gas, the sponge liquid can be directed to a third vapor-liquid equilibrium separation zone to provide a lean tail gas stream and a third liquid stream rich in $C_3^+$ hydrocarbons such as propane and isobutane recovered from the tail gas. Generally, the conditions within the third vapor-liquid separation zone will include a temperature in about the same range as the second vapor-liquid separation zone, and a pressure of from about 0.14 MPa (about 20 psia) to about 3.6 MPa (about 515 psia) and more preferably from about 1.1 MPa (about 165 psia) to about 3.2 MPa (about 465 psia). At least a portion of the lean tail gas stream is recovered for use as fuel.

The third liquid stream may be passed to a fourth vapor-liquid equilibrium separation zone to provide a recovered $C_3^+$ hydrocarbons stream such as a liquefied petroleum gas stream and a fourth liquid stream. Unlike the previously described vapor-liquid equilibrium separation zones, the fourth vapor-liquid equilibrium separation zone may be a multi-stage separation vessel such as a debutanizer column, which is well known in the art.

In one embodiment, the present invention can be used to recover $C_3^+$ hydrocarbons from tail gas from PSA units that include a partial tail gas recycle as well as those that do not recycle tail gas to the catalytic hydrocarbon conversion system recontact section. The process of contacting of the tail gas with the sponge liquid can include either the net tail gas product or may also include the recycled tail gas as well. Ideally, the tail gas recontacting will be incorporated at conditions which minimize the utility impact to the catalytic hydrocarbon conversion system.

In certain embodiments of the present invention, it is desirable to compress the PSA tail gas separately from the effluent gas produced by the catalytic hydrocarbon conversion reactor. This approach allows for the first hydrogen rich gas stream to be recontacted with the first liquid stream directly in the absence of the PSA tail gas. After this first recontacting step, a second recontacting step may take place wherein the second liquid stream may be recontacted with PSA tail gas In this way the tail gas can be contacted while the $C_3^+$ hydrocarbons are highly concentrated. In the tail gas recycle schemes known in the art, the tail gas is not recontacted with liquid stream until after it is mixed with net gas and the $C_3^+$hydrocarbons are substantially diluted In another embodiment, the present invention could also be applied to the recovery of $C_3^+$ hydrocarbons from vent gas from the debutanizer overhead of a catalytic hydrocarbon conversion system or a light naphtha isomerization unit.

A general understanding of the process and apparatus of this invention can be obtained by reference to the Figures. The Figures have been simplified by the deletion of a large number of apparatuses customarily employed in a process of this nature, such as vessel internals, temperature and pressure controls systems, flow control valves, recycle pumps, etc. which are not specifically required to illustrate the performance of the invention. Furthermore, the illustration of the process of this invention in the embodiment of a specific drawing is not intended to limit the invention to specific embodiments set out herein.

Referring now to FIG. 1, a naphtha boiling range hydrocarbon feedstock 301 is passed to a hydrocarbon conversion reaction zone 302 to produce a reaction zone effluent 303. An effluent comprising hydrogen and hydrocarbon from the reaction zone is passed via line 303 to a first vapor-liquid equilibrium separation zone 305 to provide a first hydrogen-rich gas stream 304 comprising 70 to 80 mole % hydrogen and a first liquid stream 306, comprising hydrocarbons. A portion of the first hydrogen-rich gas stream is returned to the hydrocarbon conversion reaction zone in line 304'. At least a portion of the first hydrogen-rich gas stream 304 is admixed with at least a portion of a tail gas stream 312 and at least a portion of the first liquid stream 306' to provide a first admixture 311. The first hydrogen-rich gas stream and the portion of the tail gas stream may be compressed as necessary in compressor 307 to raise the pressure to the range from about 345 kPa to about 3550 kPa (about 50 to 515 psia) prior to admixing the compressed stream with the first liquid stream. At least a portion of the tail gas stream may be compressed as necessary, preferably to a pressure ranging from 140 kPa to about 700 kPa (about 20 psia to about 160 psia), to be combined with the first hydrogen-rich gas stream to produce a hydrogen admixture. The compression of the portion of the tail gas stream and the compression of the hydrogen admixture can be performed in different stages of the same compressor 307. At least a portion and preferably all of the first liquid phase is passed via line 306' to be admixed with the hydrogen admixture in line 308 to provide the first admixture in line 308'. The first admixture is passed via line 308' to a heat exchanger 309 to precool the first admixture providing a precooled first admixture having a temperature from about 38° C. (about 100° F.) to about 10° C. (about 50° F.). The precooled first admixture is passed via line 310 to a second vapor-liquid separation zone 315 to provide a second hydrogen-rich gas stream 314 and a second liquid stream 316. The second hydrogen-rich gas stream is passed to a pressure swing adsorption zone 317 and a portion of the second liquid stream 316 is passed to downstream fractionation (not shown). Preferably the downstream fractionation will include a debutanizer column to provide a debutanized hydrocarbon product, an LPG (liquefied petroleum gas) product, and a debutanizer overhead vapor stream comprising propane. According to the present invention, at least a portion of the overhead vapor stream is returned to the recontactor, or, in another embodiment, the at least a portion of the overhead vapor is used as a copurge stream in the PSA zone.

A hydrogen product stream is withdrawn in line 320 from the pressure swing adsorption zone 317 at an adsorption pressure ranging from about 345 kPa to about 3550 kPa (about 50 psia to about 515 psia) as a high purity hydrogen product stream. A tail gas stream 319 is withdrawn from the pressure swing adsorption zone at a desorption pressure ranging from about 35 kPa to about 550 kPa (about 5 psia to about 80 psia). At least a portion of the tail gas stream is recycled to be admixed with the first hydrogen-containing vapor phase via line 312 preferably at a point between the first vapor-liquid separation zone and the recontacting zone or second vapor-liquid separator zone. A liquid stream 316' including a portion of the second liquid stream 316 is optionally admixed with sponge liquid from a sponge liquid source stream 328 creating a sponge liquid stream 329.

A portion of the tail gas stream 319 is passed via line 313 to be recontacted with sponge liquid stream 329 thereby forming a second admixture. The second admixture in line 321 is passed to a third vapor-liquid separation zone 323 to provide a lean tail gas stream 322 and a third liquid stream 324. The lean tail gas stream 322 is withdrawn for use as fuel, while the third liquid stream is passed to a fourth vapor liquid separation zone 326 to provide an LPG stream 325 and a fourth liquid stream 327.

EXAMPLES

The following examples are based on engineering design calculations and reaction zone models developed from extensive pilot plant and commercial data to more fully demonstrate the attendant advantages of the present invention.

Example 1

The following example shows the effect of recovery of $C_3^+$ hydrocarbons from tail gas from a PSA zone by contacting the tail gas with a (sponge) liquid stream. The example shows the results of a mathematical simulation which considered the use of an liquid stream, which had previously been recontacted with the hydrogen-rich gas stream from a catalytic hydrocarbon conversion reactor as described previously. Contacting of the tail gas stream with the liquid stream was conducted at −12° C. (10° F.) and 1930 kPa (280 psig). At these conditions, the majority of the $C_3^+$ hydrocarbons were recovered from the tail gas stream. See Table 1 below.

TABLE 1

| | Mass flow rate (kg $hr^{-1}$) | | | |
|---|---|---|---|---|
| Component | tail gas stream | liquid stream | lean tail gas | rich liquid stream |
| Hydrogen gas | 437.6 | 44.5 | 452.2 | 29.9 |
| methane | 2079.5 | 380.6 | 1252.0 | 1208.1 |
| ethane | 2505.7 | 2857.1 | 771.1 | 7591.6 |
| Propane ($C_3$) | 1058.4 | 6054.2 | 235.1 | 6877.5 |
| Isobutane ($C_4$) | 177.5 | 3058.4 | 37.3 | 3198.7 |
| n-butane | 168.5 | 4679.6 | 34.9 | 4813.2 |
| $C_4$ olefins | 10.4 | 331.5 | 2.1 | 339.7 |

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A process for recovering liquefied petroleum gas from tail gas, the process comprising:

(a) passing at least a portion of an effluent comprising hydrogen and hydrocarbon from a catalytic hydrocarbon conversion reaction zone to a first vapor-liquid separation zone and recovering from the first vapor-liquid separation zone a first hydrogen-rich gas stream and a first liquid stream comprising hydrocarbons;

(b) admixing a portion of the first hydrogen-rich gas stream and at least a portion of the first liquid stream to produce a first admixture;

(c) passing the first admixture to a second vapor-liquid separation zone to produce a second hydrogen-rich gas stream and a second liquid stream;

(d) passing the second hydrogen-rich gas stream to a pressure swing adsorption zone containing an adsorbent selective for the separation of hydrogen from hydrocarbons and separating the second hydrogen-rich gas stream into a third hydrogen-rich stream and a tail gas stream;

(e) admixing a portion of the tail gas stream and at least a portion of the second liquid stream to produce a second admixture; and (f) recovering liquefied petroleum gas from the second admixture.

2. The process of claim 1, further comprising recovering at least a portion of the third hydrogen-rich stream as a high purity hydrogen product.

3. The process of claim 1, wherein step (f) further comprises passing the second admixture to a third vapor-liquid separation zone to produce a lean tail gas stream and a third liquid stream.

4. The process of claim 3, wherein step (f) further comprising passing the third liquid stream to a fourth vapor-liquid separation zone to produce a liquefied petroleum gas stream and a fourth liquid stream.

5. The process of claim 4 wherein the liquefied petroleum gas stream and the tail gas stream comprise $C_3^+$ hydrocarbons.

6. The process of claim 5, wherein the $C_3^+$ hydrocarbons comprise isobutane and propane.

7. The process of claim 1, wherein the tail gas stream is not recycled to the catalytic hydrocarbon conversion reaction zone.

8. The process of claim 1, wherein second admixture of step (e) further comprises admixing a sponge liquid.

9. A process for recovering liquefied petroleum gas from tail gas, the process comprising:

(a) passing at least a portion of an effluent comprising hydrogen and hydrocarbon from a catalytic hydrocarbon conversion reaction zone to a first vapor-liquid separation zone and recovering from the first vapor-liquid separation zone a first hydrogen-rich gas stream and a first liquid stream comprising hydrocarbons;

(b) admixing a portion of the first hydrogen-rich gas stream and at least a portion of the first liquid stream to produce a first admixture;

(c) passing the first admixture to a second vapor-liquid separation zone to produce a second hydrogen-rich gas stream;

(d) passing the second hydrogen-rich gas stream to a pressure swing adsorption zone containing an adsorbent selective for the separation of hydrogen from hydrocarbons and separating the second hydrogen-rich gas stream into a third hydrogen-rich stream and a tail gas stream;

(e) admixing a portion of the tail gas stream and a second liquid stream to produce a second admixture; and (f) recovering liquefied petroleum gas from the second admixture.

10. The process of claim 9, wherein second liquid stream comprises a sponge liquid.

* * * * *